US011845162B2

(12) United States Patent
Chartier et al.

(10) Patent No.: US 11,845,162 B2
(45) Date of Patent: Dec. 19, 2023

(54) PIPE WRENCHES

(71) Applicant: Ridge Tool Company, Elyria, OH (US)

(72) Inventors: Glen R. Chartier, Avon Lake, OH (US); James E. Hamm, Grafton, OH (US); Hiten Mansukh Chauhan, Pune (IN); Rahul Maruti Nanche, Maharashtra (IN); Craig J. Nitchman, Wakeman, OH (US); Ashok Bhagwat Patil, Pune (IN)

(73) Assignee: Ridge Tool Company, Elyria, OH (US)

( * ) Notice: Subject to any disclaimer, the term of this patent is extended or adjusted under 35 U.S.C. 154(b) by 828 days.

(21) Appl. No.: 16/789,956

(22) Filed: Feb. 13, 2020

(65) Prior Publication Data

US 2020/0180122 A1 Jun. 11, 2020

Related U.S. Application Data

(63) Continuation-in-part of application No. 15/832,138, filed on Dec. 5, 2017, now abandoned.

(30) Foreign Application Priority Data

Aug. 31, 2017 (IN) ..... 201741030854

(51) Int. Cl.

| | |
|---|---|
| ***B25B 13/50*** | (2006.01) |
| ***B25B 13/12*** | (2006.01) |
| ***B25B 23/00*** | (2006.01) |

(52) U.S. Cl.

CPC ..... *B25B 13/5058* (2013.01); *B25B 13/12* (2013.01); *B25B 23/0007* (2013.01)

(58) Field of Classification Search

CPC .. B25B 13/5058; B25B 13/12; B25B 23/0007
USPC ..... 81/126
See application file for complete search history.

(56) References Cited

U.S. PATENT DOCUMENTS

| | | | | |
|---|---|---|---|---|
| 494,529 A | | 3/1893 | Jenks | |
| 1,074,936 A | * | 10/1913 | Evans | B25B 13/5058 81/103 |
| 1,380,566 A | | 6/1921 | Kiefer | |
| 1,495,751 A | | 5/1924 | Larson | |

(Continued)

FOREIGN PATENT DOCUMENTS

| | | |
|---|---|---|
| CN | 1449895 A | 10/2003 |
| CN | 2717621 Y | 8/2005 |

(Continued)

OTHER PUBLICATIONS

CN Office Action and Search Report dated Jul. 29, 2021; CN 202010673557.7; 14 pages.

(Continued)

*Primary Examiner* — Hadi Shakeri
(74) *Attorney, Agent, or Firm* — Mark Bandy; Rankin Hill & Clark, LLP

(57) ABSTRACT

Wrenches commonly known as "pipe wrenches" which include sidewall surface configurations within a channel extending through a housing component of the wrench are described. Also described are wrenches that include one or more shim components that can be positioned in the housing channel. In addition, methods for reducing failure or fracturing of the wrench due to application of high side or lateral loads are described.

7 Claims, 8 Drawing Sheets

(56) References Cited

U.S. PATENT DOCUMENTS

| | | | | | |
|---|---|---|---|---|---|
| 1,727,623 | A | | 9/1929 | Thewes | |
| 2,302,633 | A | | 11/1942 | Ingwer et al. | |
| 2,656,751 | A | * | 10/1953 | Johnson | B25B 13/5058 81/186 |
| 2,704,477 | A | | 3/1955 | Wright | |
| 2,742,809 | A | * | 4/1956 | Brynge | B25B 13/5058 81/101 |
| 4,580,468 | A | * | 4/1986 | Cox | B25B 13/22 81/145 |
| D483,238 | S | * | 12/2003 | Hsieh | D8/22 |
| D657,213 | S | | 4/2012 | Pond et al. | |
| D748,958 | S | | 2/2016 | Chartier et al. | |
| 10,994,405 | B2 | * | 5/2021 | Li | B25B 13/5058 |
| 2009/0193940 | A1 | | 8/2009 | Kuo | |
| 2014/0373687 | A1 | | 12/2014 | Chkautovich | |
| 2015/0000110 | A1 | | 1/2015 | Papazian | |

FOREIGN PATENT DOCUMENTS

| | | | |
|---|---|---|---|
| CN | 2818080 | Y | 9/2006 |
| CN | 201455865 | U | 5/2010 |
| CN | 205465884 | U | 8/2016 |
| CN | 106715052 | A | 5/2017 |
| DE | 112013004681 | | 7/2015 |
| WO | WO2015161318 | A1 | 10/2015 |

OTHER PUBLICATIONS

Exam Report; Application No. DE102018214118.5; dated Mar. 23, 2020; 10 pages.

* cited by examiner

PIPE WRENCHES

REFERENCE TO RELATED APPLICATIONS

The present patent application is a continuation-in-part of U.S. Ser. No. 15/832,138 filed Dec. 5, 2017 which, in turn, is based upon Indian patent application Serial Number 201741030854, the benefit of which is hereby claimed for purposes of priority.

FIELD

The present subject matter relates to wrenches in general and, in particular, relates to wrenches (commonly known as "pipe wrenches") having housing components that include expanded or curved openings into which other components of a wrench can be inserted. Accordingly, the present subject matter includes insertion of a shank and one or more shims into housing openings of a wrench. In addition, the present subject matter provides methods for avoiding failure of, or damage to, wrench components and to the surfaces thereof, that would otherwise be caused by excessive lateral loading or pressure applied to such wrench components, or to the operative surfaces thereof.

BACKGROUND

Such wrenches (commonly known as "pipe wrenches") have a "fixed" or heel jaw (referred to herein either as "a fixed lower jaw" or simply as "a lower jaw") secured to a handle, as well as a movable or "hooked" jaw (referred to herein as "an upper jaw") that is able to pivot, to a limited extent, about the handle. Typically, the hooked jaw can be selectively positioned, relative to the heel jaw, by rotating a certain threaded member typically located on such wrenches. In operation, pivoting action of the hook jaw causes the hook jaw and heel jaw to close a gap, between, when a rotational force is applied to the handle. Gripping force and torque are thusly simultaneously applied to a workpiece.

In order to increase loads or force applied to the wrench, users often place an end of a length of pipe, or other elongated member, over the wrench handle, in order to effectively lengthen the handle. During application of a force to the lengthened handle, such as during a user's act of gripping a surface of a workpiece, lateral displacement of the handle may occur, relative to a plane in which the force is applied. As a result, such lateral displacement may apply, and often does apply, significant forces, and resulting pressure, to surfaces of the wrench housing, which may cause damage to the wrench. Possibly resulting in fracture of the wrench body, typically along regions of the housing.

Accordingly, an improved wrench or wrench housing is desired by the skilled professionals using such wrenches, the housings of which exhibit increased capacity to perform as desired, during periods of increased side or lateral loading. It is particularly desired that such wrench housings possess increased capacity, relative to conventional wrenches, for loads associated with lateral displacement of the handle during gripping of a workpiece. Moreover, it is desirable to provide users with an improved wrench or wrench housing, capable of withstanding side or lateral loading to an extent greater than provided by conventional wrenches, without damage to or fracture of the wrench body.

SUMMARY

The difficulties and drawbacks associated with previous approaches are addressed in the present subject matter as follows.

In one aspect, the present subject matter provides a wrench comprising a handle having a distal end and a proximate end. The wrench also comprises a movable upper jaw having a shank. The shank includes a threaded region. The wrench also comprises a housing integrally formed with the proximate end of the handle. The housing includes a lower jaw portion and a channel sized to receive the shank of the movable upper jaw. The shank of the upper jaw is disposed in the channel. The wrench also comprises a rotatable member threadedly engaged with the threaded region of the shank of the upper jaw. The member is rotatably secured to at least one of the handle and the housing. Upon rotation of the member, the distance between the lower jaw and the upper jaw is selectively adjusted. The channel extends between a first opening on a first face of the housing and a second opening on a second face of the housing. The first face is directed toward the upper jaw and the second face is directed toward the distal end of the handle. The area of the first opening is greater than the area of the second opening.

In another aspect, the present subject matter provides a wrench comprising a handle and a housing affixed to the handle. The housing defines a first face and a second face oppositely directed from the first face. The housing includes a lower jaw proximate the first face. The housing defines a plurality of interior walls defining a channel that extends through the housing between the first face and the second face. The wrench also comprises a movable upper jaw having a shank. The shank includes a threaded region. At least a portion of the shank is disposed in the channel in the housing. The wrench also comprise a rotatable member threadedly engaged with the threaded region of the shank of the upper jaw. The member is rotatably secured to at least one of the handle and the housing. Upon rotation of the member, the distance between the lower jaw and the upper jaw is selectively adjusted. At least one of the interior walls extending through the housing includes an arcuate region.

In yet another aspect, the present subject matter provides a wrench comprising a movable upper jaw having a shank. The shank includes a threaded region. The wrench also comprises a handle having a distal end and a proximate end. The wrench additionally comprises a housing integrally formed with the proximate end of the handle. The housing includes a lower jaw portion and a channel sized to receive the shank of the movable upper jaw. The shank of the upper jaw is disposed in the channel. The channel is defined by a plurality of interior walls extending through the housing. The wrench also comprises a rotatable member threadedly engaged with the threaded region of the shank of the upper jaw. The member is rotatably secured to at least one of the handle and the housing. Upon rotation of the member, the distance between the lower jaw and the upper jaw is selectively adjusted. The wrench also comprises a shim disposed in the channel and at least a portion of the shim positioned between the shank and at least three interior walls of the plurality of interior walls defining the channel.

In still another aspect, the present subject matter provides a method of increasing capacity of a wrench to lateral loading. The method comprises providing a wrench including a handle, a housing having a lower jaw and a channel defined by a plurality of interior walls extending through the housing, a movable upper jaw having a threaded shank and the shank disposed in the channel, a rotatable member threadedly engaged with the threaded shank such that upon rotation of the member the distance between the lower jaw and the upper jaw is selectively adjusted. The method also comprises incorporating at least one feature in the housing of the wrench, in which the feature is selected from (i) wherein at least one of the interior walls of the plurality of interior walls that define the channel, includes an arcuate portion, (ii) wherein the channel extends between a first opening and a second opening defined on the housing, and the area of the first opening is greater than the area of the second opening, (iii) wherein the plurality of interior walls that define the channel include a pair of diverging interior walls, and (iv) a shim disposed in the channel and positioned between at least three of the interior walls of the plurality of interior walls and the shank.

As will readily be admitted by one of ordinary skill in the art, the subject matter described herein is capable of various other embodiments, different from each other. As a result, any details associated with all such embodiments are capable of modifications in various respects, without departing from the spirit of appended claims. Accordingly, the description and drawings are all to be regarded as illustrative and not restrictive.

DETAILED DESCRIPTION OF THE EMBODIMENTS

The present subject matter discloses and is generally directed to wrenches (commonly referred to as "pipe wrenches") that exhibit increased capacity to withstand and thus resist damage to housing components of the wrench upon application by a user of a laterally-directed load or force to wrench components. Such resistance to damage to the wrench housing results from one or both of the following features.

One feature is the incorporation of inner wall surface configurations within a channel extending through the wrench housing within which a shank component of the wrench is disposed. In particular, the channel wall surface configurations or geometries can include (i) a pair or select pairs of interior walls diverging apart from each other; (ii) a pair or select pairs of interior wall(s) having one or more regions or portions that are arcuate or non-linear; and/or, for housings having opposing faces, (iii) a pair or select pairs of openings at opposing faces (of the wrench housing) that have different sizes.

Another feature of the present subject matter is the use of a shim component that is disposed in the channel of the wrench housing. Briefly, the shim is positioned at least partially around the shank of the upper jaw, between the shank and at least three of the interior walls that define the channel extending through the wrench housing.

One or both of these features or variations thereof, may be incorporated in a wrench. Incorporating such features into wrenches has been found to surprisingly and unexpectedly result in significant increases in load capacity of the wrench of the present subject matter, demonstrating an ability to avoid damage resulting from lateral loading.

Figure 1:
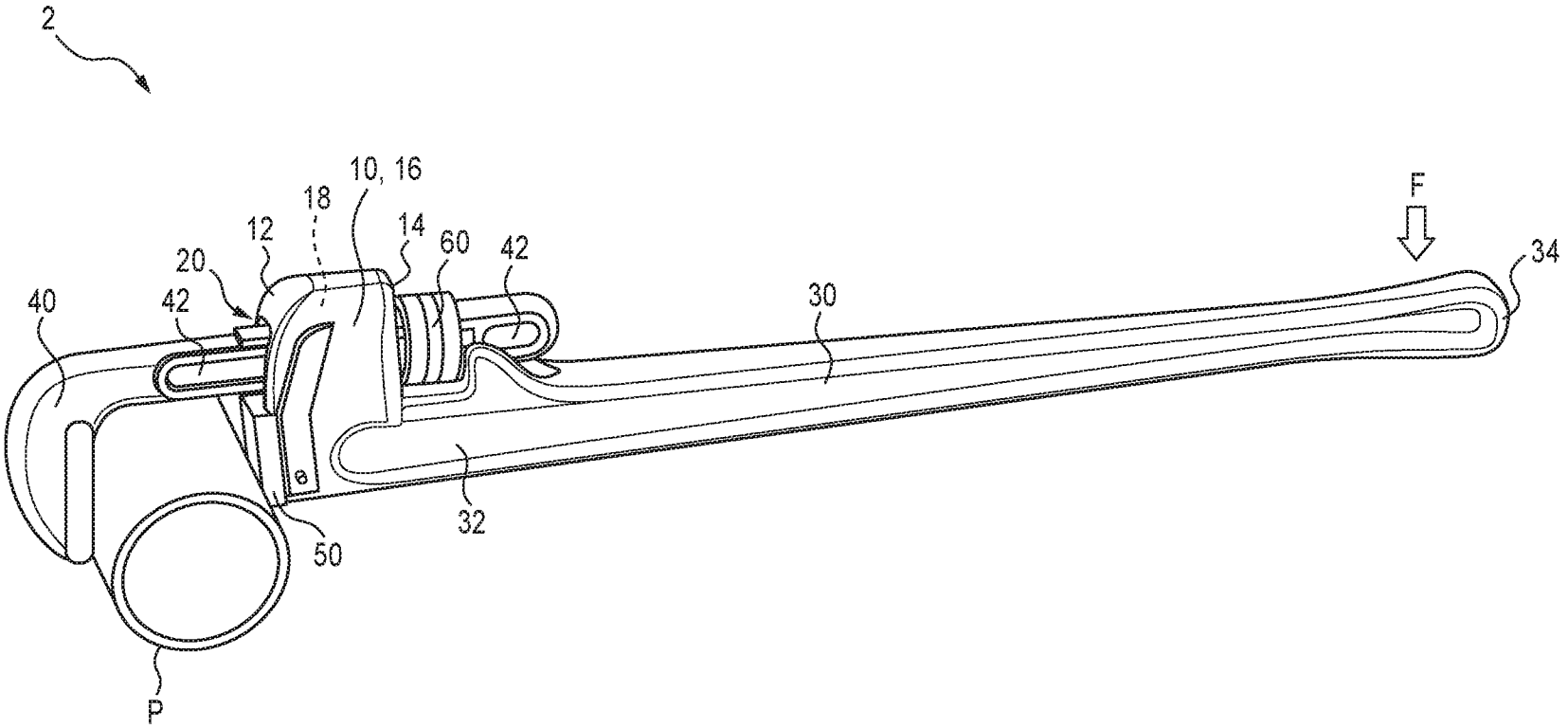
FIG. 1 is an illustration of an embodiment of a wrench in accordance with the present subject matter applied to a typical work piece such as a length of pipe.
Figure 2:
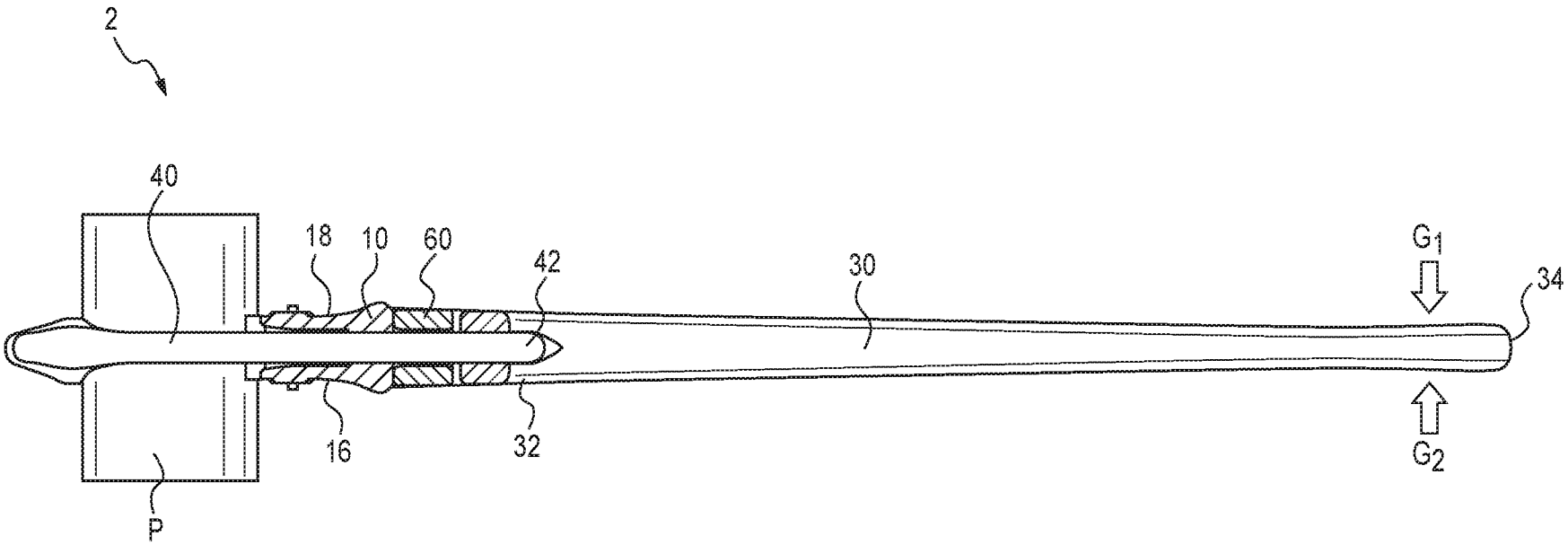
FIG. 2 is a top view of the wrench and pipe depicted in FIG. 1.

FIGS. 1 and 2 illustrate an embodiment of a wrench 2 in accordance with the present subject matter. The wrench 2 generally comprises a housing 10, a handle 30, a movable upper jaw 40, a lower jaw 50, and a rotatable member 60 for adjusting the distance between the upper jaw 40 and the lower jaw 50. The wrench 2 is shown gripping a workpiece or pipe P. The handle 30 has a proximate end 32 and an opposite distal end 34. The movable upper jaw 40 is integral with a shank 42 having a threaded region. The housing 10 is typically unitarily formed joined to the proximate end 32 of the handle 30. The housing 10 defines a first face 12, a second face 14 spaced from the first face 12, a first lateral side 16, and an oppositely directed second lateral side 18. The first face 12 is generally directed toward a work region of the wrench 2, and the second face 14 is generally directed toward the distal end 34 of the handle 30. The housing 10 defines a channel 20 extending entirely through the housing 10 between the first face 12 and the second face 14. The channel 20 is sized to receive the shank 42 of the upper jaw 40. Rotatable member 60, having threads matching threads of shank 42, is threadedly engaged with the threaded region of shank 42. The rotatable member 60 is, accordingly, rotatably secured to one or both of the handle 30 and/or the housing 10. It will be understood by one of ordinary skill in the art, that upon rotation of member 60 relative to shank 42, a distance or gap between jaws 40 and 50 is selectively adjusted.

FIG. 1 also depicts a typical force F applied to the handle 30 of wrench 2 during a user's act of gripping of workpiece P. As is clear to one of ordinary skill in the art, the pivoting action of the upper jaw 40 thus causes the upper jaw 40 and the lower jaw 50 to tighten onto the workpiece P, while the force F is applied to the handle 30.

FIG. 2 further depicts typical lateral forces $G_1$ and $G_2$, either of which may be applied to the handle 30 of the wrench 2. Application of such lateral forces $G_1$ or $G_2$ may result in damage to a conventional wrench. Such lateral forces $G_1$ and/or $G_2$ may be applied intentionally or unintentionally by a user; and, in certain situations, a user may attempt to apply a significant amount of force F at the distal end 34. (See FIG. 1.)

Figure 3:
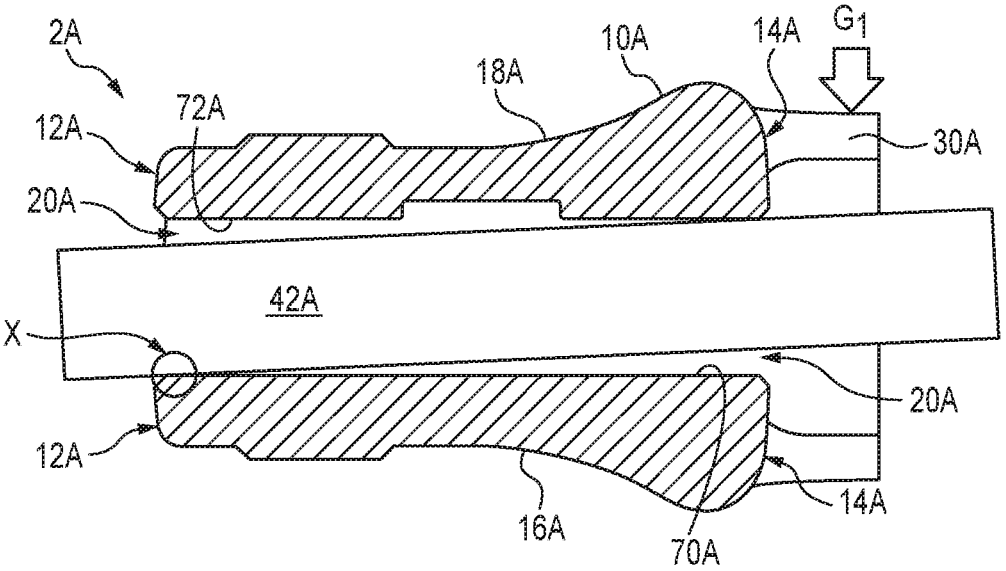
FIG. 3 (PRIOR ART)
FIG. 3 is a cross section of a side view of certain operational components of a conventional wrench during application of lateral loading.

FIG. 3 is a cross sectional side view of a conventional wrench 2A during an application of a lateral force $G_1$. For convenience, reference numerals of conventional wrench components that correspond to components of the embodiments of the present subject matter are denoted with a suffix "A." For example, the housing component of a conventional wrench 2A is denoted as housing 10A. Referring further to FIG. 3, upon the application of lateral force $G_1$ to the handle 30A and housing 10A of a conventional wrench 2A, the upper jaw and associated shank 42A of the conventional wrench 2A are laterally displaced in the channel 20A that extends through the housing 10A. As a result of such lateral displacement, when the conventional wrench 2A is thus used, a relatively small surface area (or region) of contact (identified with an "x" in FIG. 3) is illustrated, between the shank 42A and an interior wall 70A of the channel 20A, where the force or load is applied. As mentioned, such a region of contact "x" is typically relatively small in surface area and, therefore, the resulting load or force applied to such a relatively small surface area at that region is relatively high. Thus, if the lateral force $G_1$ is high enough and the resulting surface-area pressure great enough, then damage—including material fracture—can occur at such a region of contact, occasionally resulting in wrench failure.

Figure 4:
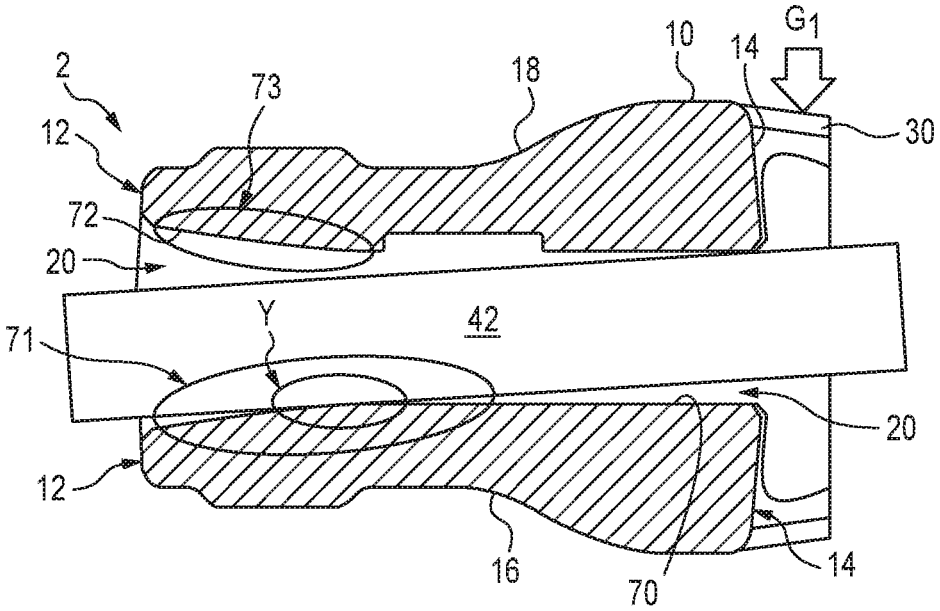
FIG. 4 is also a cross sectional view of operational components of a wrench in accordance with the present subject matter, during such application of lateral loading.

FIG. 4 is a cross section of one embodiment of a wrench 2 in accordance with the present subject matter. In this embodiment, wrench 2 includes a housing 10 defining a channel 20 extending entirely through the housing 10 between the first and second faces 12 and 14, both of which are defined by the housing 10. (Please also see FIG. 1.) The channel 20 includes a plurality of interior wall surfaces which are also defined by the housing 10. Any one of the plural interior wall surfaces of the channel 20 may include predetermined surface-area configurations. Accordingly, it is contemplated that such surface-area configurations, within the scope of the present subject matter, can be represented by a plurality of spaced-apart interior wall portions, or at least one pair of spaced-apart diverging wall portions, or at least one pair of spaced-apart interior wall surfaces (each of which define an arcuate region). It is further contemplated that only one interior wall surface of a spaced-apart pair of interior wall surfaces of channel 20 can have an interior wall surface portion defining an arcuate region. As an example, the channel 20 (shown in FIG. 4) is defined—at least in part—by interior walls 70 and 72 extending through the housing 10 between the first and second faces 12 and 14. (See FIG. 1.) It is understood by one of ordinary skill in the art that housing 10 and shank 42 can be manufactured from various conventional materials including various metals and metal alloys, commercially-available and known to one of ordinary skill in the art. Furthermore, one of ordinary skill in the art can appreciate, when a relatively large load or force is applied to the housing 10 or shank 42 (causing a surface portion of the shank 42 and at least one interior wall surface-portion of channel 20 to contact along a region therebetween), that the housing 10 and shank 42 are able to deflect to an effective degree or amount (along the above-mentioned region located therebetween) without causing failure of or damage to either the housing 10 or shank 42. Accordingly, in order to prevent damage to wrench components resulting from application of force $G_1$ and subsequent deflection of the component surfaces in contact with such a load or force, the interior wall 70 includes an arcuate region (e.g., of convex curvature) 71 adjacent the face 12 and extending along at least a portion of interior wall 70. As a result, a region of contact (identified with a "y" in FIG. 4) is present in the channel 20 along a portion of interior wall 70 between the shank 42 and the interior wall 70. In accordance with the present subject matter, such a surface-area region of contact "y" (provided by a wrench of the present subject matter) is significantly greater, in surface area, than the surface-area region of contact "x" provided by a conventional wrench, as illustrated by FIG. 3. Thus, the associated pressure applied at the surface-area region "y" is less than the pressure experienced at the region "x" for the same lateral force $G_1$. It is therefore expected that the potential for damage to a wrench of the present subject matter and its components—including its housing—would be reduced, in comparison to the potential for damage to a conventional wrench. As another example of the present subject matter, FIG. 4 also illustrates an arcuate (e.g., convex curvature) region 73 extending along at least a portion of the interior wall 72. Accordingly, as illustrated by FIG. 4, a portion of at least one of the interior wall surfaces 70 and 72 of channel 20 defines a surface configuration that is effective for causing the load or force to be applied to a relatively larger surface area portion of said at least one of the pair of interior wall surfaces 70 and 72 located between the first and second faces 12 and 14 of the housing 10 for causing the load or force to be transferred, for example, from a location adjacent the "hooked" (see FIG. 1) upper jaw 40 to a relatively stronger section of the housing 10. For example, and as illustrated in FIG. 4, such a relatively stronger section of the housing 10 may possibly be spaced away from the first face 12 and further toward the second face 14 of housing 10. Moreover, and as FIG. 4 also illustrates, such a surface configuration can be shaped to provide an effective amount of arcuate surface-area region or convex curvature 71 and/or 73 for causing the load to be applied to a relatively larger surface-area portion of said at least one of the pair of the interior wall surfaces 70 and 72, whereupon the load, is located between the first and second faces 12 and 14 (of the housing 10), in the direction of the second face 14.

In many embodiments, when an arcuate region of a surface-area portion of an interior wall is provided, the surface area of the arcuate region constitutes at least about 10%, in certain embodiments at least about 25%, and in other embodiments at least about 50% of the total surface area of an interior wall extending between opposite faces 12, 14 of the housing 10. Thus, as illustrated by FIG. 4, e.g., the surface area of arcuate region 71 constitutes, for certain embodiments of the present subject matter, at least about 10%, for other embodiments of the present subject matter, about 25%, and for still other embodiments of the present subject matter, at least about 50% of the total surface area of the interior wall 70 extending between faces 12 and 14 of housing 10.

The present subject matter includes surface configurations (or geometries) for portions of interior wall surfaces of channel 20 extending through housing 10, resulting in transfer of a load to a stronger section or region of the housing 10 and the transfer and distribution of the load over a relatively larger surface area, whenever a wrench (incorporating principles of the present subject matter) is used in a manner for which it was intended. As an example of these principles, channel 20 could include a pair of diverging interior walls extending through at least part of housing 10. Or, the channel 20 could include interior walls that include multiple arcuate regions or arcuate portions. Or, the channel 20 could include two interior walls having arcuate portions opposed to each other. Or, the channel 20 could include one or more interior walls with arcuate portions, where at least one such interior wall of housing 10 defines at least one arcuate surface portion spaced between faces 12 and 14 of housing 10, as illustrated in FIG. 4.

Figure 5:
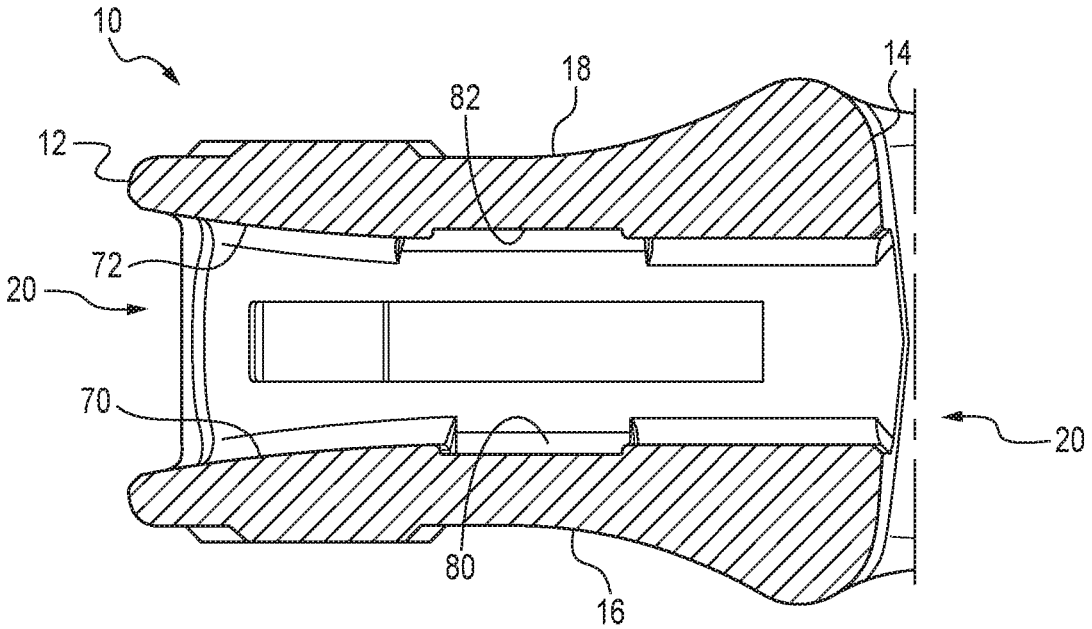
FIG. 5 is yet another cross sectional view of the wrench housing depicted in FIG. 4 in accordance with the present subject matter.

FIG. 5 further illustrates housing 10 in accordance with the present subject matter without upper jaw 40 and shank 42 disposed in the channel 20. In this version, one or more recessed "pocket" regions 80, 82 are provided in walls of the channel 20. In the version shown in FIG. 5, a first pocket region 80 is provided along interior wall 70 at a midpoint of channel 20 between faces 12, 14. In addition, a second pocket region 82 is provided along interior wall 72 at a midpoint of channel 20 between faces 12, 14. Accordingly, one or more such pocket region(s) are used to retain a shim, as follows.

Certain conventional wrenches include a shim or similar component within a housing of the wrench. Such shims or similar components typically function as a spring or biasing member to urge the shank of the upper jaw toward the center of the channel.

Figure 6:
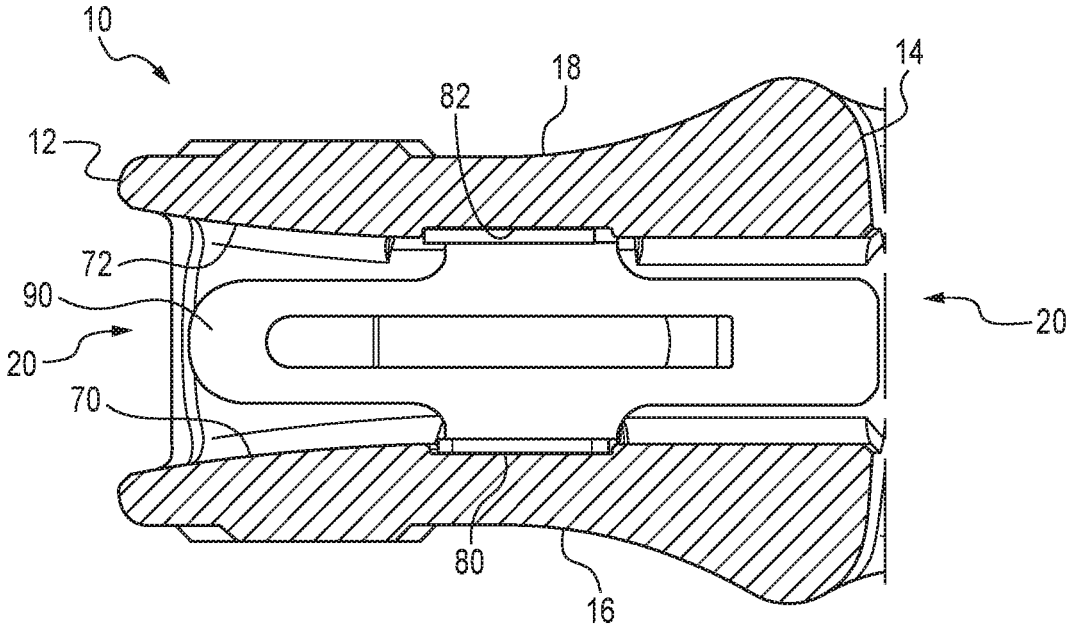
FIG. 6 is a cross section of the wrench housing depicted in FIG. 5 and a shim positioned in a housing channel in accordance with the present subject matter.

In accordance with the present subject matter, a novel shim is provided and positioned within a housing to further distribute lateral loading of forces along regions of increased surface area of wrench components in order to reduce a potential for damage to wrench components as a result of laterally-disposed forces also called "side" loading. FIG. 6 illustrates an embodiment of a shim 90 in accordance with the present subject matter. Shim 90 is disposed in the previously described housing 10. In certain versions of the present subject matter, shim 90 is configured to reside within one or more pocket regions (e.g., pocket regions 80, 82) in channel 20. Yet, it will be understood that the present subject matter includes shims not configured for placement in pocket regions.

Figure 7:
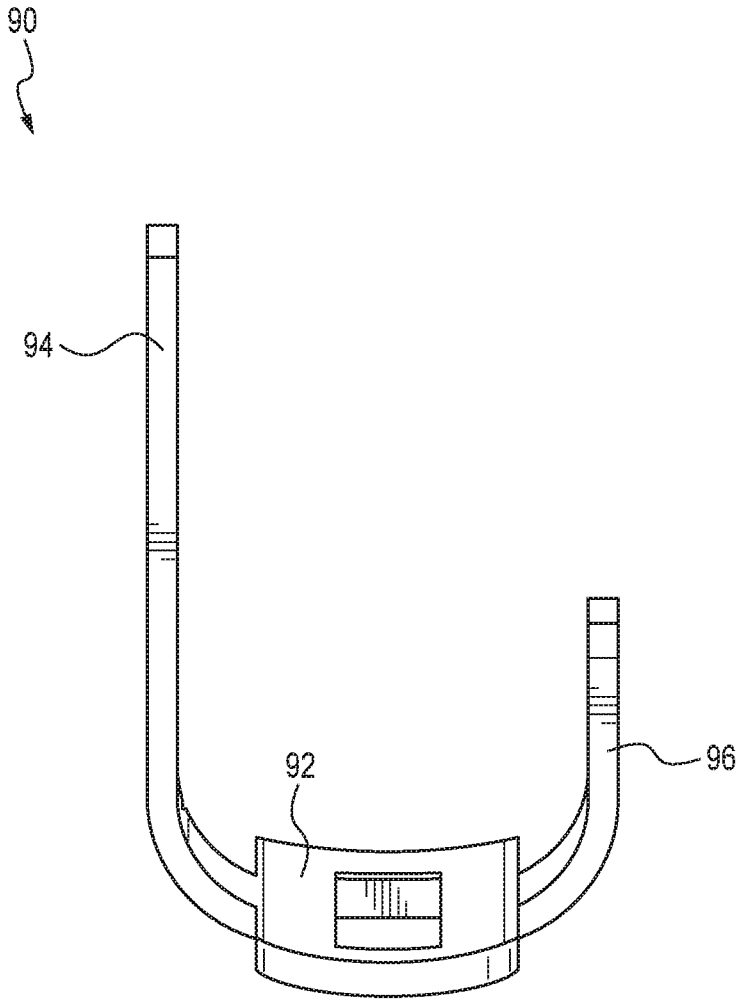
FIG. 7 is a schematic view of the shim shown in FIG. 6.

FIG. 7 further illustrates the shim 90 in accordance with the present subject matter. The shim 90 includes a central member 92, a first leg 94 extending outward from the central member 92, and a second leg 96 extending outward from the central member 92. In certain versions, the legs 94 and 96 extend parallel to each other and are spaced apart from one another. In the particular version depicted in FIG. 7, the first leg 94 is longer than the second leg 96. However, it will be appreciated that the present subject matter includes a wide array of variant configurations for the shims. The present subject matter also includes shim assemblies which include two or more components that when disposed in a channel as described herein, function as a shim for the purpose of urging the shank of an upper jaw toward the center of the channel.

Referring to FIGS. 6 and 7, the illustrated shim 90 is positioned in the channel 20 relative to the shank 42 of an upper jaw (not shown in FIG. 6) disposed in channel 20 such that a portion of the shim 90, for instance, the first leg 94 is disposed between the shank 42 and an interior wall, such as wall 70, and another portion of the shim 90, for instance, the second leg 96 is disposed between the shank 42 and an interior wall such as wall 72, and yet another portion of the shim 90 such as the central member 92 is disposed between the shank 42 and still another interior wall of channel 20. Thus, for this embodiment of the present subject matter, the shim now positioned at least partially around the shank, is located between at least three of the interior walls and the shank.

Figure 8:
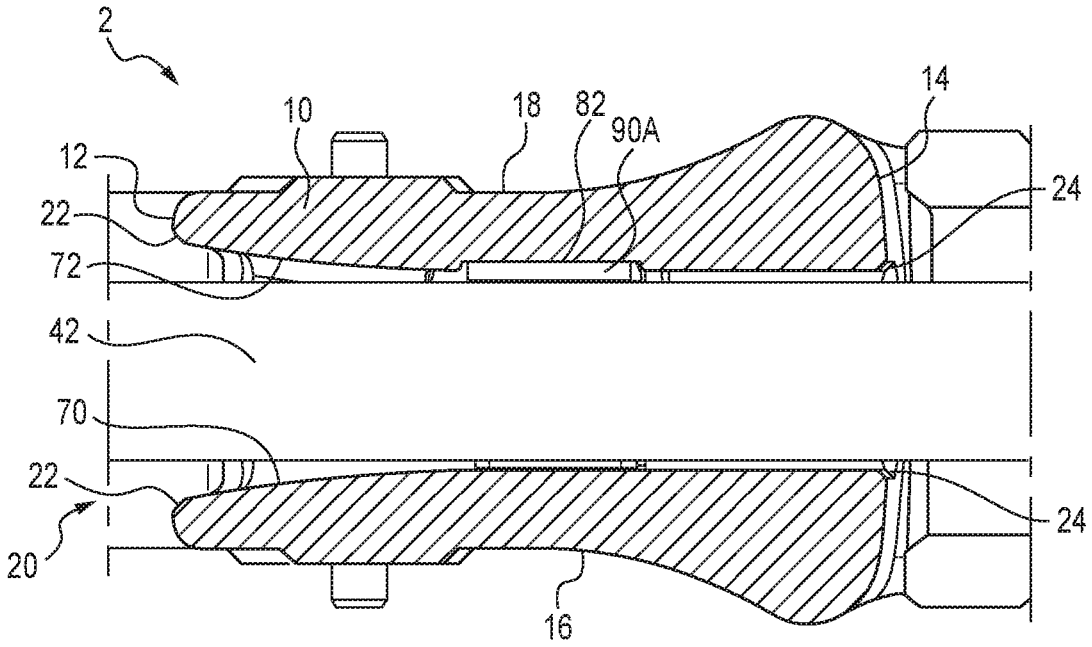
FIG. 8 is a cross section of a wrench having a housing in accordance with the present subject matter and a conventional shim component.

The present subject matter also includes the use of conventional shims in a wrench housing that utilizes one or more channel features as described herein. For example, FIG. 8 illustrates a wrench 2 having a housing 10 and upper jaw 40 with a shank 42 disposed in a channel 20. The channel is defined at least in part by interior walls 70 and 72. A single pocket region 82 is provided along the interior wall 72. A conventional shim 90A is at least partially positioned in the single pocket region 82.

Figure 9:
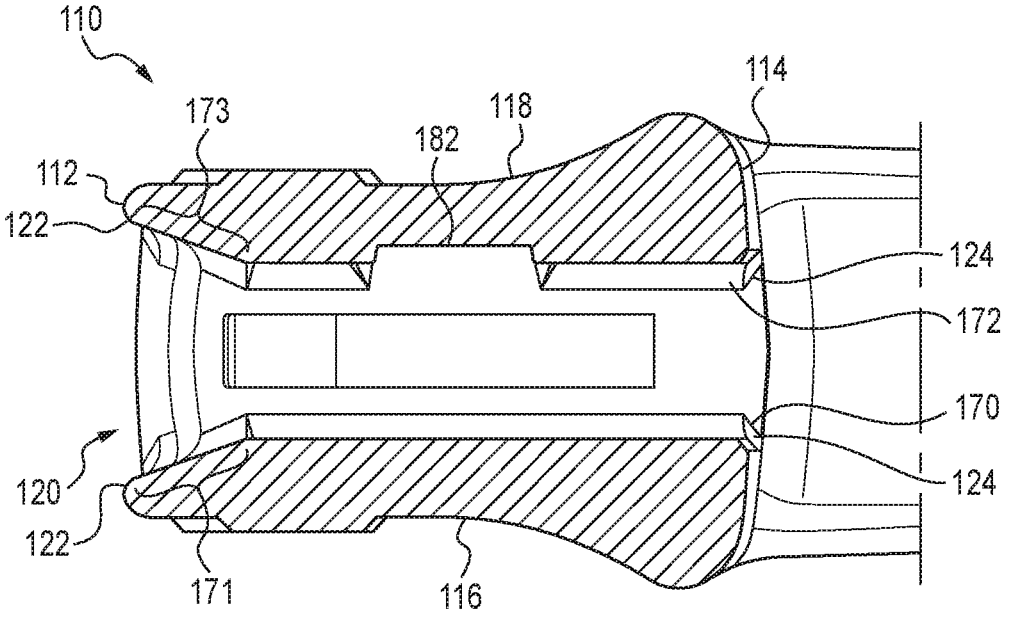
FIG. 9 is a cross section of yet another embodiment of a wrench housing in accordance with the present subject matter.

The present subject matter includes housings having a variety of different geometries and configurations of the channel. FIG. 9 illustrates another embodiment of a wrench housing 110 in accordance with the present subject matter. For convenience, components are similarly numbered as corresponding components of the previously described embodiment best shown in FIG. 5. FIG. 9 illustrates the housing 110 as defining first and second faces 112, 114 and a channel 120 extending therebetween. In this embodiment, each of the interior walls 170 and 172 includes a diverging wall portion 171 and 173, respectively. In many embodiments, the diverging wall portions 171 and 173 constitute at least 10%, in certain embodiments at least 25%, and in particular embodiments at least 50% of the respective interior wall. Thus for example, the length of the diverging wall portion 171 constitutes at least 10%, in certain embodiments at least 25%, and in particular embodiments at least 50% of the total length of the interior wall 170. Although FIG. 9 illustrates a single pocket region 182, it will be understood by one of ordinary skill in the art that the present subject matter accordingly includes two or more pocket regions that are provided along interior walls of the channel 120.

In many embodiments of the present subject matter, the channel through the housing extends between openings on the first and second faces of the housing which differ in size. For example, referring to FIG. 8 for example, the housing 10 is provided with a channel 20 extending between a first opening 22 defined by the first face 12 and a second opening 24 defined by the second face 14 of housing 10. Similarly, housing 110 (shown in FIG. 9) is provided with a channel 120 extending between a first opening 122 through the first face 112 and a second opening 124 through the second face 114. In accordance with an aspect of the present subject matter, the area of the first opening 122 (also 22) is greater than the area of the second opening 124 (as compared to 24). Thus, in particular embodiments, the area of the first opening 22, 122 is greater than the area of the second opening 24, 124 by a specified amount such as, for example, about 110%, about 120%, about 130%, about 140%, or about 150%, or more. Thus, it will be understood by one of ordinary skill in the art, that in this aspect of the present subject matter, surface configuration or geometries of a channel extending between the first and second openings can be in different forms besides the embodiments described herein.

Figure 10:
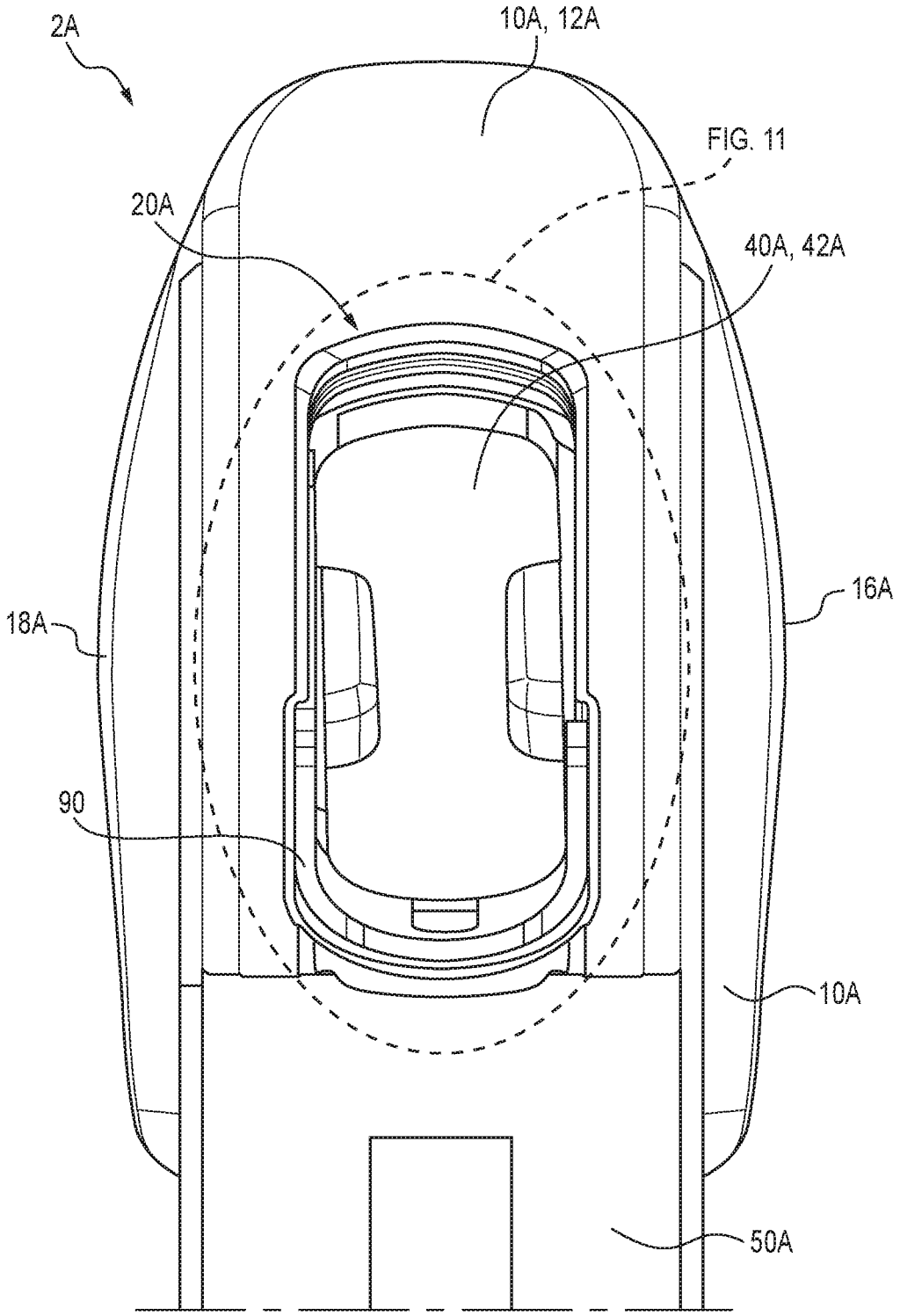
FIG. 10 is an end view of a conventional wrench housing with a shim of the present subject matter positioned in a channel of the housing.

The present subject matter includes the use of a conventional housing with a shim of the present subject matter. FIG. 10 is an end view of a conventional wrench 2A and housing 10A with a shim 90 of the present subject matter. FIG. 10 illustrates a housing 10A and a first face 12A of the housing 10A, with a channel 20A extending through the housing 10A. The housing 10A defines first and second lateral sides 16A and 18A, respectively. The housing 10A is affixed or otherwise integrally formed with a lower jaw 50A. A shank 42A of an upper jaw 40A is disposed in the channel 20A. The previously described shim 90 is also disposed in the channel 20A and is positioned at least partially around the shank 42A.

Figure 11:
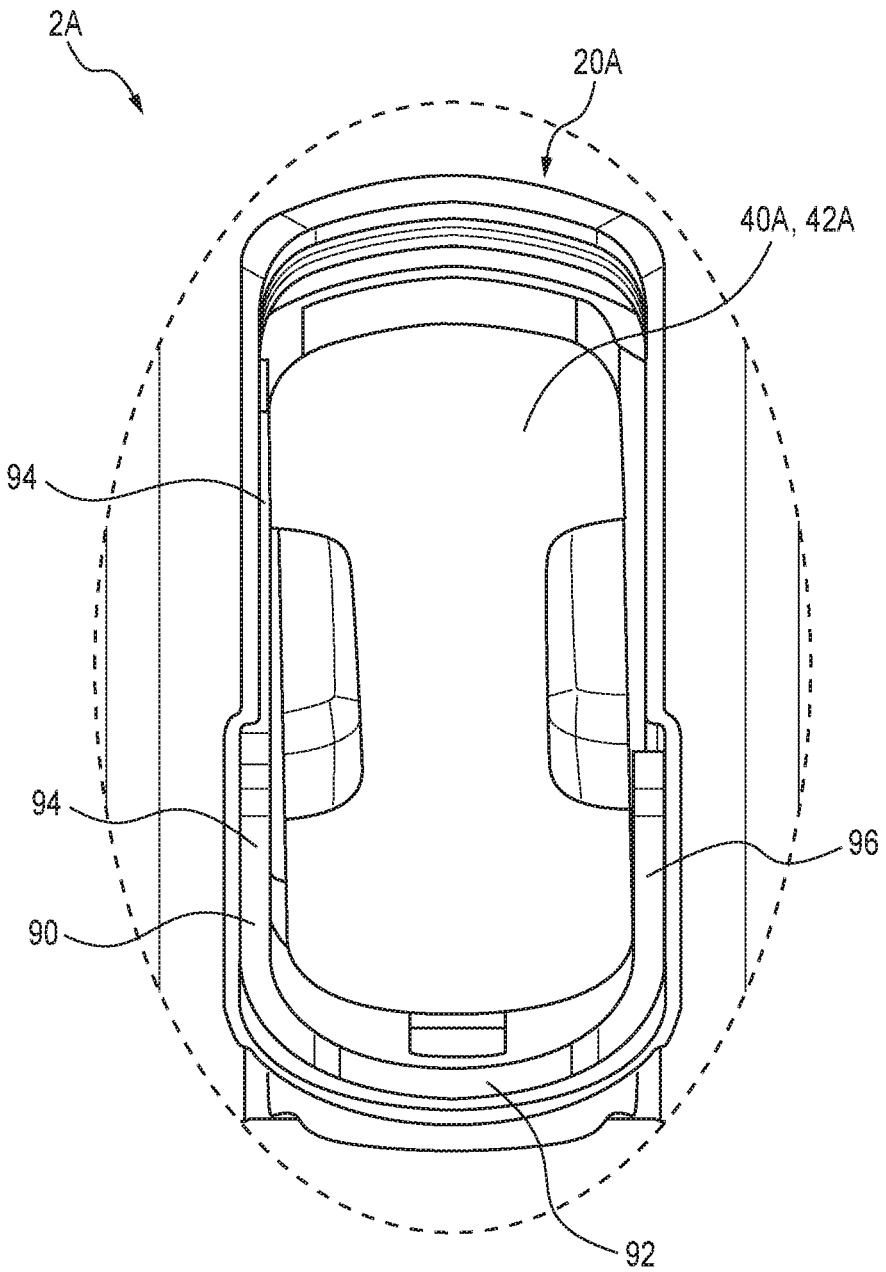
FIG. 11 is a detailed end view of a conventional wrench housing with an embodiment of a shim component in accordance with the present subject matter, as depicted in FIG. 10.

FIG. 11 is a detailed end view showing the shim 90 and its position in the channel 20A and relative to the shank 42A of the upper jaw 40A. The first leg 94 of the shim 90 is positioned between the shank 42A and an interior wall that defines a portion of the channel 20A. The second leg 96 of the shim 90 is positioned between the shank 42A and another interior wall of the channel 20A. Moreover, for this embodiment of the present subject matter, central member 92 (mentioned above with respect to FIGS. 6, 7) is positioned between the shank 42A and yet another interior wall of the channel 20A.

The present subject matter also provides methods for reducing potential for failure of a wrench due to excessive lateral loading of the wrench, and thus increase capacity of the wrench to lateral loading. The methods of the present subject matter thus involve one or both of (i) a provision for a channel extending through the wrench housing in which the channel exhibits certain surface configurations or geometrical features as described herein; and/or (ii) a provision for a particular shim component in the channel as described herein. Utilization of one or both of these methods has been found to significantly increase capacity of the wrench to accommodate side or lateral loading without damage occurring to the wrench and particularly the wrench housing.

Various other benefits will become apparent to those of ordinary skill in the art from future application and development of the technology of the present subject matter.

All patents, applications, commercial products and their safety standards, and any technical articles noted herein are hereby incorporated by reference in their entirety.

The present subject matter includes all operable combinations of features and aspects of the present subject matter described and/or illustrated herein. For example, if one feature is described in association with a certain embodiment and another feature is described in association with another embodiment, it is understood that the present subject matter includes all such embodiments having a combination of these features.

As described hereinabove, the present patent disclosure identifies problems faced by ordinary users of common wrenches, and solves many problems associated with conventional wrenches commonly called pipe wrenches. Yet, it will be appreciated by those of ordinary skill in the art that changes in detail, or arrangement of components described and illustrated herein to explain the nature of the present subject matter, can easily be made by those of ordinary skill in the art, without departing from the principles and scope of the present subject matter, as expressed in the appended claims.

What is claimed is:

1. In a wrench comprising:

a handle defining an integral housing; a shank defining a longitudinal axis and having an end portion that defines a first jaw; and a second jaw spaced from the first jaw and fixed to the housing; wherein the housing defines: a first face located adjacent the second jaw; a second face spaced from the first face; and a channel having a plurality of interior wall surfaces through the housing between the first and second faces; wherein a lateral force applied to one of the handle and the housing causes a portion of the shank adjacent the first face to be laterally displaced in the channel and to contact a relatively flat portion of at least one of the interior wall surfaces, resulting in a load being applied by the shank to a relatively small surface area portion of said at least one of the interior wall surfaces located in the housing closely adjacent the first face; wherein the improvement comprises:

at least a portion of said at least one of the interior lateral wall surfaces defining a surface configuration including a convex region extending at least partially between said faces effective for causing the load to be applied to a relatively larger surface area portion of said at least one of the interior lateral wall surfaces located between the first and second faces thereby causing the load to be transferred from a location adjacent the first jaw to a stronger section of the housing.

2. The wrench of claim 1, wherein the shank is elongated and defines external threads substantially along the entire length thereof.

3. The wrench of claim 2, further including an internally-threaded member encircling the shank and having threads that mate with the threads of the shank, wherein the threads of the member are in meshing engagement with the threads of the shank, whereby rotation of the member about the longitudinal axis, relative to the shank, causes one of the first and second jaws to move relative to the other of the first and second jaws, for causing the first jaw to be extended from and retracted into the channel of the housing.

4. The wrench of claim 1, wherein the convex region is adjacent the first face.

5. The wrench of claim 1, wherein the convex region is adjacent the second face.

6. The wrench of claim 1, wherein the convex region includes a convex curvature.

7. The wrench of claim 1, wherein the housing includes two interior lateral wall surfaces, each including the convex region.

* * * * *